United States Patent [19]

Fuchs, Jr.

[11] Patent Number: 4,644,775

[45] Date of Patent: Feb. 24, 1987

[54] SHELL FORMING APPARATUS AND PROCESS

[76] Inventor: Francis J. Fuchs, Jr., P.O. Box 10016, Naples, Fla. 33941

[21] Appl. No.: 745,304

[22] Filed: Jun. 14, 1985

[51] Int. Cl.[4] ..... B21D 22/26; B21D 22/20

[52] U.S. Cl. ..... 72/348; 72/355; 72/356; 72/393; 72/402

[58] Field of Search ..... 72/348, 347, 355, 357, 72/356, 393, 402

[56] References Cited

U.S. PATENT DOCUMENTS

| | | | |
|---|---|---|---|
| 1,530,000 | 3/1925 | Kauffmn | 72/347 |
| 2,198,873 | 4/1940 | Hinsdale | 72/355 |
| 2,419,563 | 4/1947 | Kaser | 72/347 X |
| 3,113,377 | 12/1963 | Oakes | 72/355 |
| 3,459,021 | 8/1969 | Fuchs, Jr. | 72/347 |
| 3,495,433 | 2/1970 | Fuchs, Jr. | 72/347 |
| 3,509,785 | 5/1970 | Fuchs, Jr. | 72/347 |
| 4,343,174 | 8/1982 | Hahn et al. | 72/348 |
| 4,470,287 | 9/1984 | Antonov et al. | 72/347 |

*Primary Examiner*—Daniel C. Crane
*Attorney, Agent, or Firm*—R. Gale Rhodes, Jr.

[57] ABSTRACT

Apparatus and process of manufacture for forming a generally cylindrical shell having an interior surface, an opened end with a first internal diameter, a generally closed opposite end, a first internal portion intermediate the ends with a second internal diameter larger than the first internal diameter, and a second internal portion intermediate the first internal portion and the closed end with a third internal diameter larger than the second internal diameter, wherein such apparatus and process of manufacture include a mandrel having an outer surface for forming the interior surface of the shell and having an expandable and contractable intermediate portion, the mandrel intermediate portion expandable outwardly to form its second internal portion and upon the shell being formed the mandrel intermediate portion contractable inwardly sufficiently to permit the mandrel to be moved relatively away from the formed shell through the open end to permit the formed shell and the mandrel to be separated.

15 Claims, 26 Drawing Figures

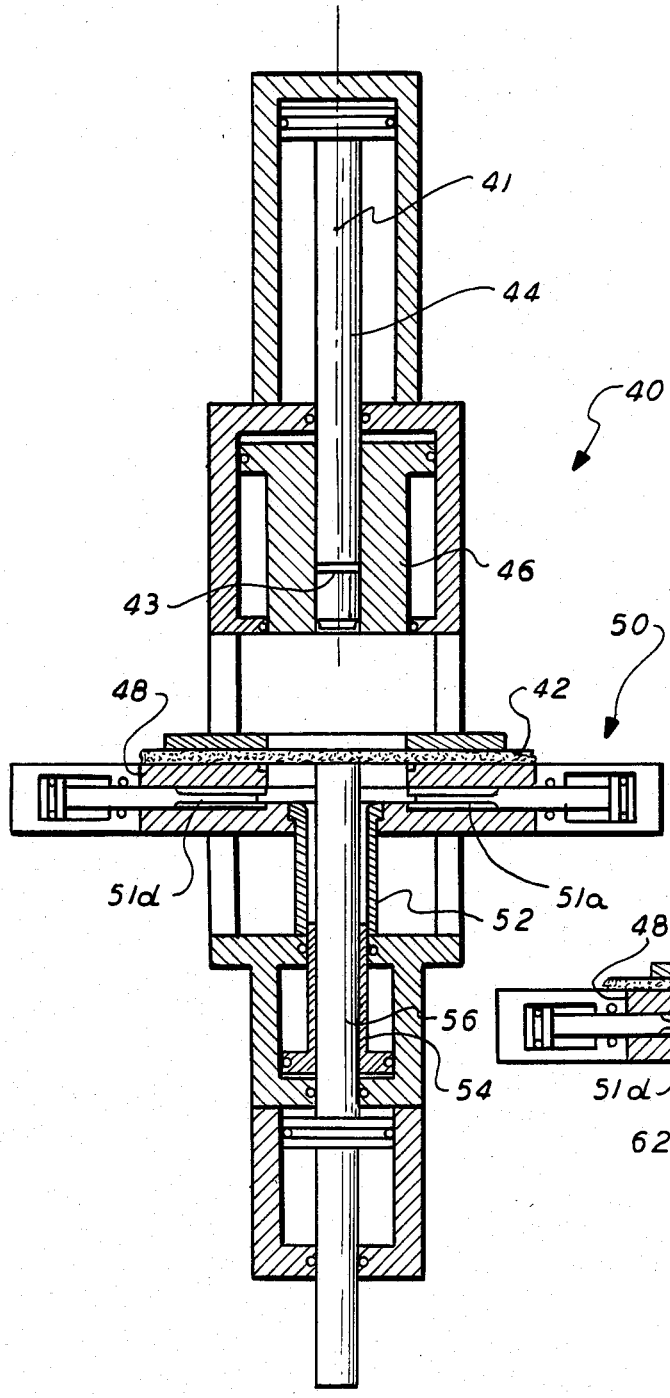
FIG. 3
FIG. 4
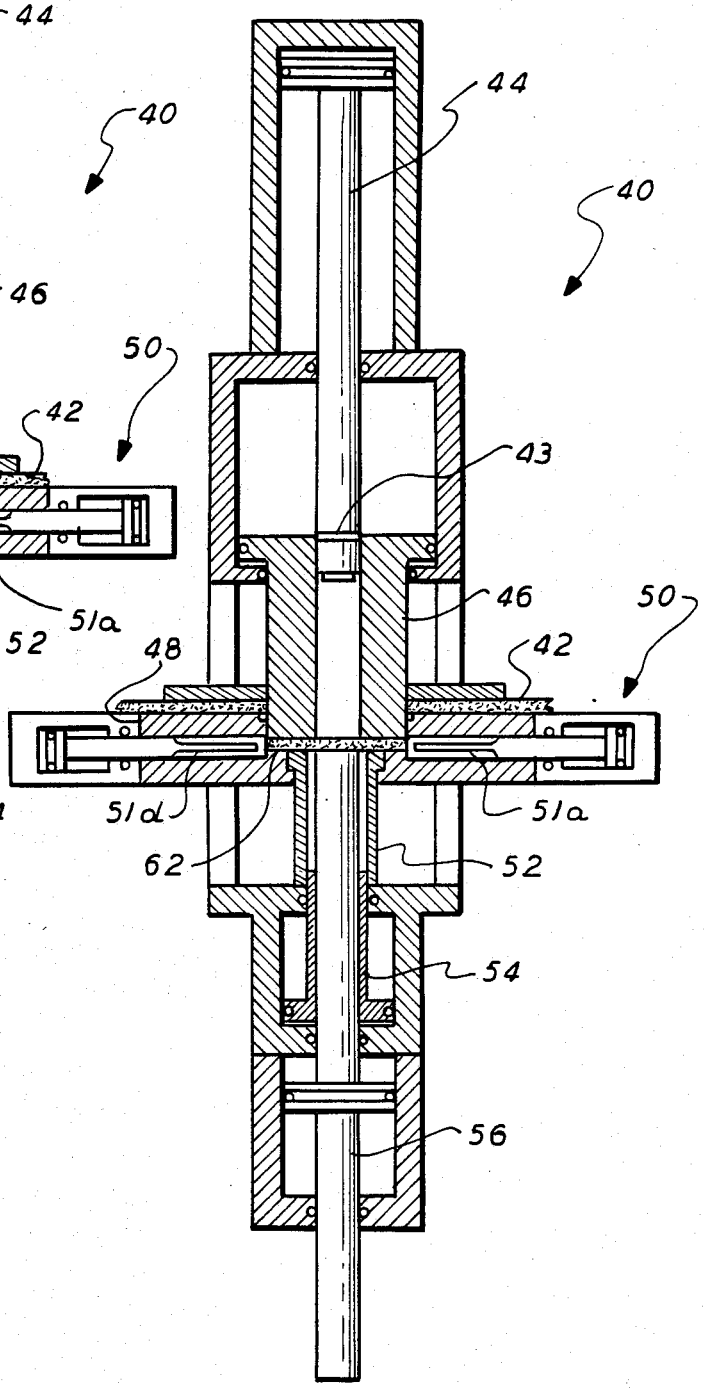

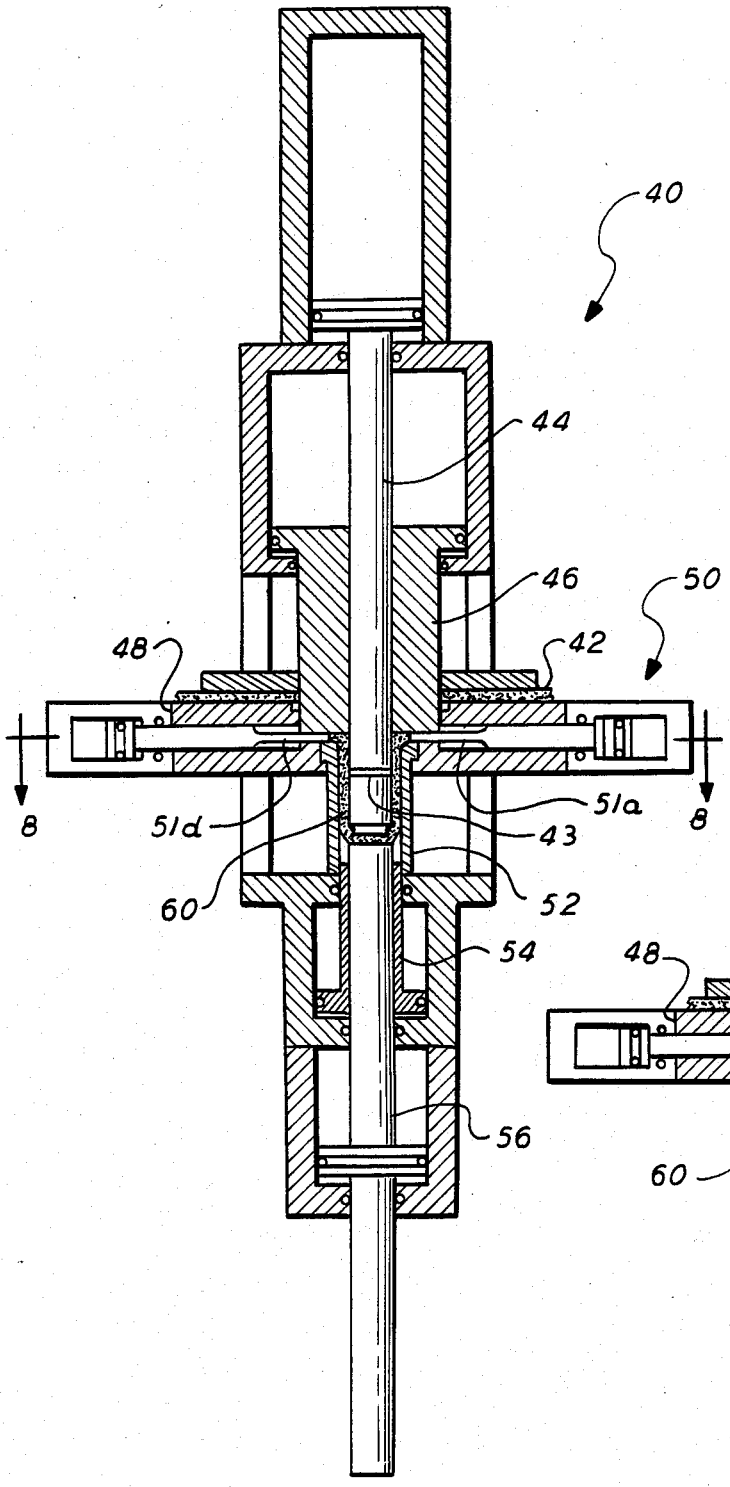
FIG. 5
FIG. 6
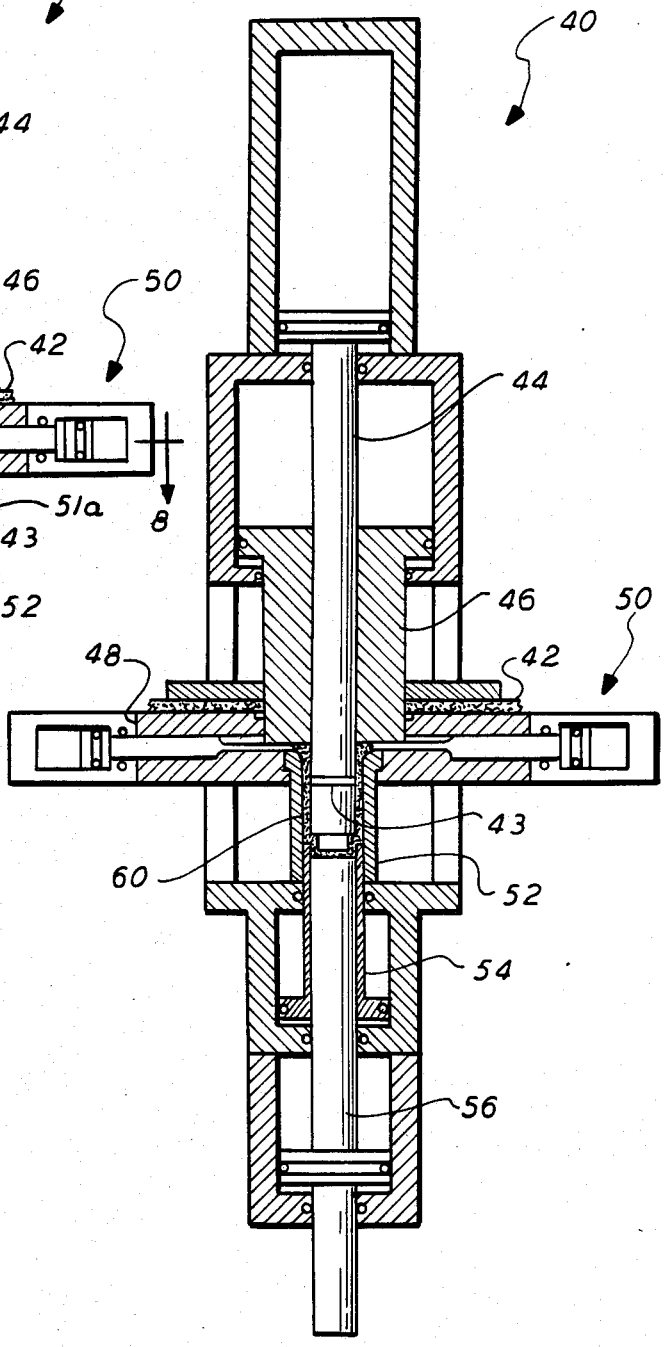

FIG.8
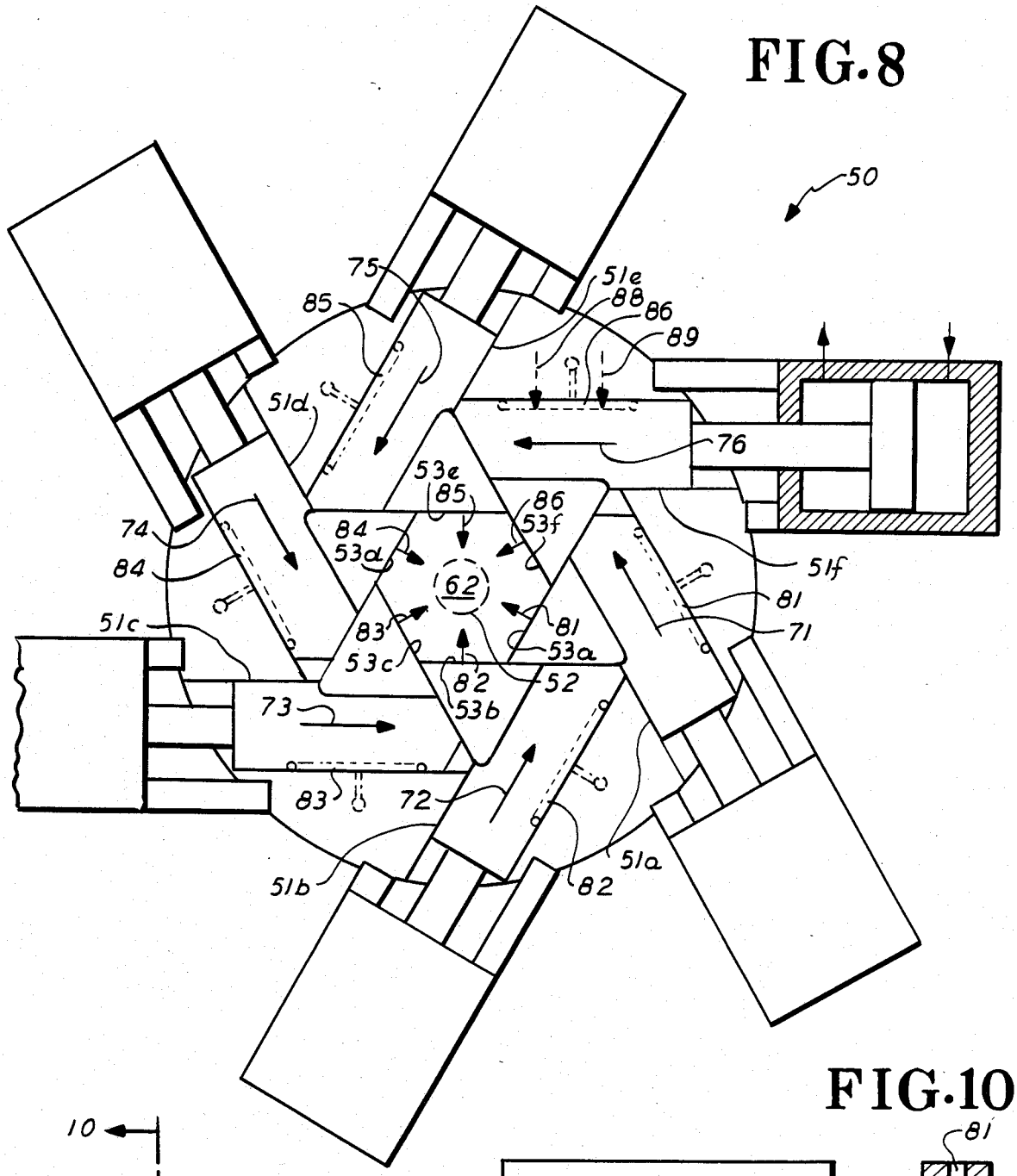
FIG.10
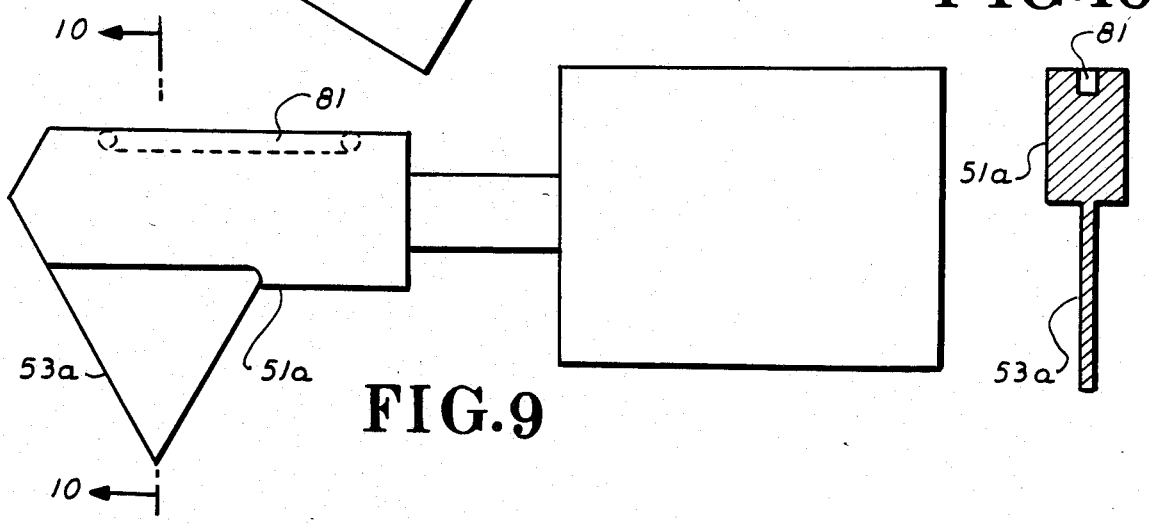
FIG.9

FIG. 17
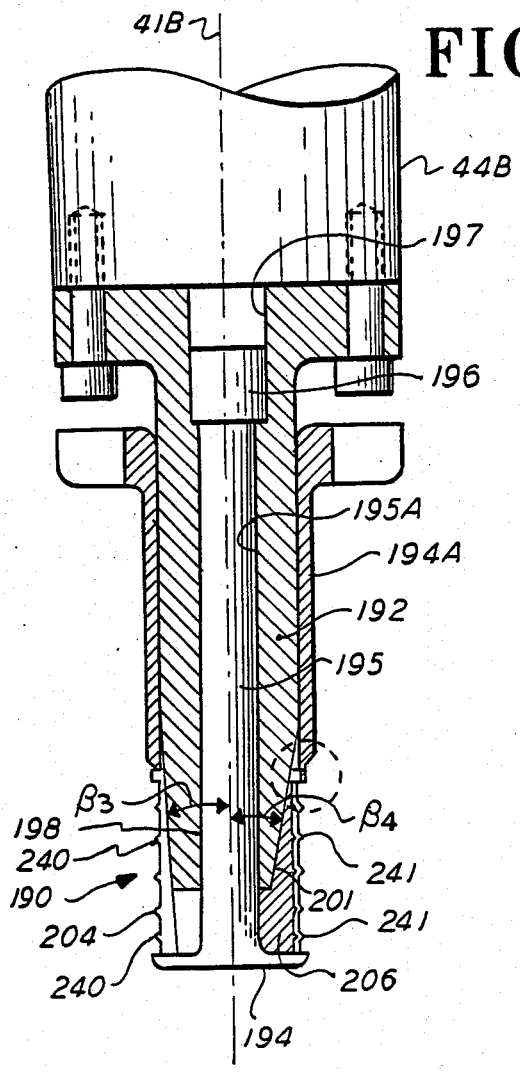
FIG. 17A
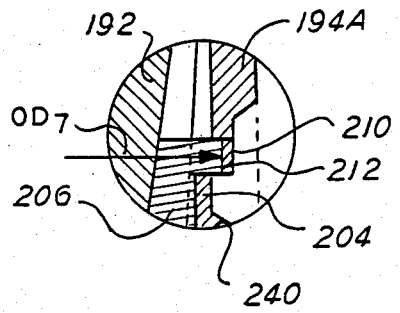
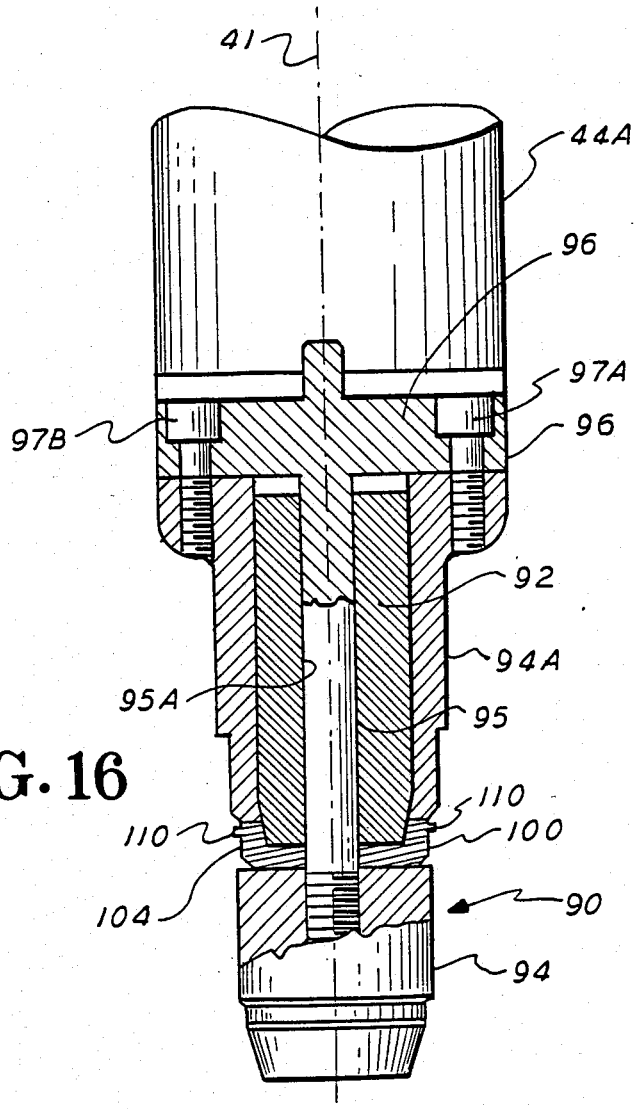
FIG. 16

SHELL FORMING APPARATUS AND PROCESS

FIELD OF THE INVENTION

This invention relates generally to improved shell forming apparatus generally of the type disclosed in U.S. Pat. Nos. 3,459,021 issued Aug. 5, 1969; 3,495,433 issued Feb. 17, 1970; and 3,509,785 issued May 5, 1970; all issued to F. J. Fuchs, Jr., the inventor of the present invention. More particularly this invention relates to improved shell forming or extruding apparatus for forming a generally cylindrical shell having an interior surface, a first end with a first internal diameter, a generally closed opposite end, a first internal portion intermediate said ends with a second internal diameter smaller than said first internal diameter, and a second internal portion intermediate said first internal portion and said closed end with a third internal diameter larger than said second internal diameter

BACKGROUND OF THE INVENTION

Referring now to FIG. 1, there is shown a closed shell indicated by general numerical designation 10 and which shell may be formed advantageously by the apparatus and process of the present invention. The shell 10, in accordance with the teachings of the present invention set forth below, is for being formed, such as by being extruded or drawn, in a forming die 12 and with a reciprocably mounted mandrel 14. The exterior surface of the mandrel 14 forms the interior surface of the shell 10 and the interior surface of the forming die 12 forms the exterior shell surface. It will be noted from FIG. 1 that the shell 10 has an open end 16 having an internal diameter $ID_1$, a closed end 17, a first internal portion 18 intermediate the open and closed ends having an internal diameter $ID_2$ smaller than $ID_1$, a second internal portion 19 intermediate the first internal portion 18 and the closed end 17 having an internal diameter $ID_3$ larger than $ID_2$, and internal lower portions as shown (e.g. lower internal portion 20 having internal diameter $ID_4$) each having an internal diameter not larger than $ID_2$. To form the interior surface of the shell 10, the mandrel 14, of course, must be provided with portions of complementary shape to the opposed portions of the interior surface of the shell as shown, such portions 21–25 from top to bottom having, respectively, outer diameter $OD_1$, outer diameter $OD_2$, outer diameter $OD_3$, and outer diameter $OD_4$. After forming, the mandrel 14 is retracted or moved away from the formed shell 10, but it will be noted that since mandrel portion 23 having outer diameter $OD_3$ is larger than the internal portion 18 of the formed shell having internal diameter $ID_2$, it is not possible to retract the mandrel 14 as shown from the formed shell 10, or it is not possible to so retract the mandrel 14 without damage to or destruction of the internal portion 18 of the formed shell 10. Shell 10 may be a grenade body of the type broadcast by a large projectile or shell (such as a howitzer shell) over a general area and which grenade body typically contains a shaped charge and upon the grenade body striking an object, such as an enemy tank, explodes.

Shown in FIG. 2 is another closed shell which is indicated by general numerical designation 30 and which closed shell may be also a grenade body of the same type as closed shell 10 of FIG. 1. The grenade body 30 is a generally cylindrical shell having an open end 31 with a first internal diameter $ID_6$, a generally closed opposite end 32, a first internal portion 33 intermediate the ends and having an internal diameter $ID_7$ smaller than internal diameter $ID_6$ and a second internal portion 34 intermediate the first internal portion 33 and the closed end 32 with an internal diameter $ID_8$ larger than the internal diameter $ID_7$ of the first internal portion 33. Further, as may be noted from FIG. 2, the grenade body 30 may have its lower interior portion embossed as indicated by the area identified by numerical designation 35. Such embossing is produced by indentations, e.g. 36, 37 and 38, having internal diameters $ID_9$, $ID_{10}$, and $ID_{11}$ larger than internal diameter $ID_7$ of internal portion 33; in the closed shell 30 internal diameters $ID_8$–$ID_{11}$ are equal. In addition, the shell 30 may be provided at its lower or closed end portion with a shoulder 39 for facilitating stacking, or axial alignment, of a plurality of such shells.

To form the interior surface of the grenade body 30 as shown, the outer surface of the mandrel (not shown for clarity of presentation) must, of course, be of complementary shape to the interior surface of the grenade body, and must be provided with outwardly extending ridges for forming the internal portion 34 and the indentations 36, 37 and 38, and hence if solid such a mandrel could not be retracted from the formed shell (or at least not so without damage to the formed shell) since the mandrel portions forming the shell portions having internal diameters $ID_8$–$ID_{11}$ would be larger than internal diameter $ID_7$ of shell internal portion 33; thus, the solid mandrel could not be retracted past internal portion 33 of the shell (without shell damage) to separate the formed shell and the solid mandrel.

Accordingly, there exists a need in the art for apparatus including a mandrel for forming a closed shell (e.g. shell 10 or 30) and a process for using the same, wherein the mandrel is provided with an expandable and a contractable intermediate portion for being expanded to form a second internal portion (e.g. 19 or 34) of the closed shell intermediate a first internal portion (e.g. 18 or 33) of the shell and the closed end of the shell wherein the second internal portion (e.g. 19 or 34) of the shell has an inner diameter ($ID_3$ or $ID_8$–$ID_{11}$) larger than the internal diameter ($ID_2$ or $ID_7$) of the first internal portion of the shell, and wherein the mandrel intermediate portion is contractable to permit the mandrel to be withdrawn past the first internal portion (e.g. 18 or 33) of the formed shell and through the open end of the formed shell to separate the mandrel and shell after forming.

Preferably, as is known to those skilled in the art, for shell forming such as shell 10 of FIG. 1 or shell 30 of FIG. 2, the mandrel must be solid or at least must be solid, or substantially solid, during shell forming. Accordingly, there exists a need in the art for a mandrel, and process for using the same, where the mandrel is comprised of a plurality of parts so as to be expandable and contractable for the reasons described above but which plurality of mandrel parts are formed into a solid, or a substantially solid, mandrel during shell forming.

SUMMARY OF THE INVENTION

The object of the present invention is to provide apparatus and process of manufacture for forming a generally cylindrical shell having an exterior surface, an open end with a first internal diameter, a generally closed opposite end, a first internal portion intermediate said ends with a second internal diameter smaller than the first internal diameter and a second internal portion intermediate the first internal portion and the closed end with a third internal diameter larger than the second internal diameter.

The foregoing object is accomplished by apparatus and process of manufacture of the present invention including a mandrel having an outer surface for forming the interior surface of the shell and having an expandable and contractable intermediate portion, the mandrel intermediate portion expandable outwardly to form the second internal portion and upon the shell being formed the mandrel intermediate portion contractable inwardly sufficiently to permit the mandrel to be moved relatively away from the formed shell through the open end to permit the formed shell and the mandrel to be separated.

BRIEF DESCRIPTION OF THE DRAWINGS

FIGS. 3–7 are cross-sectional elevational views of apparatus embodying the present invention, and for practicing the process of the present invention, and which FIGS. show a closed shell in various stages of forming in accordance with the teachings of the present invention;

FIG. 8 is a top view of an iris die embodying the present invention and taken generally along the line 8—8 in FIG. 5 in the direction of the arrows;

FIG. 9 is a top view of an individual iris forming member of the iris die of FIG. 8;

FIG. 10 is a cross-sectional view taken along the line 10—10 in FIG. 9 in the direction of the arrows;

in FIG. 11 the intermediate portion is shown contracted;

in FIG. 15A the members are contracted radially inwardly and in FIG. 15B the members are expanded radially outwardly;

FIG. 16 is a view similar to FIG. 12 but taken along a plane perpendicular to the view of FIG. 12;

FIG. 17 is a view similar to FIG. 11 but of an alternate embodiment of the mandrel of the present invention;

FIG. 17A is an enlarged view of a portion of FIG. 17 as indicated in the drawings;

DESCRIPTION OF THE PREFERRED EMBODIMENTS

Figure 1:
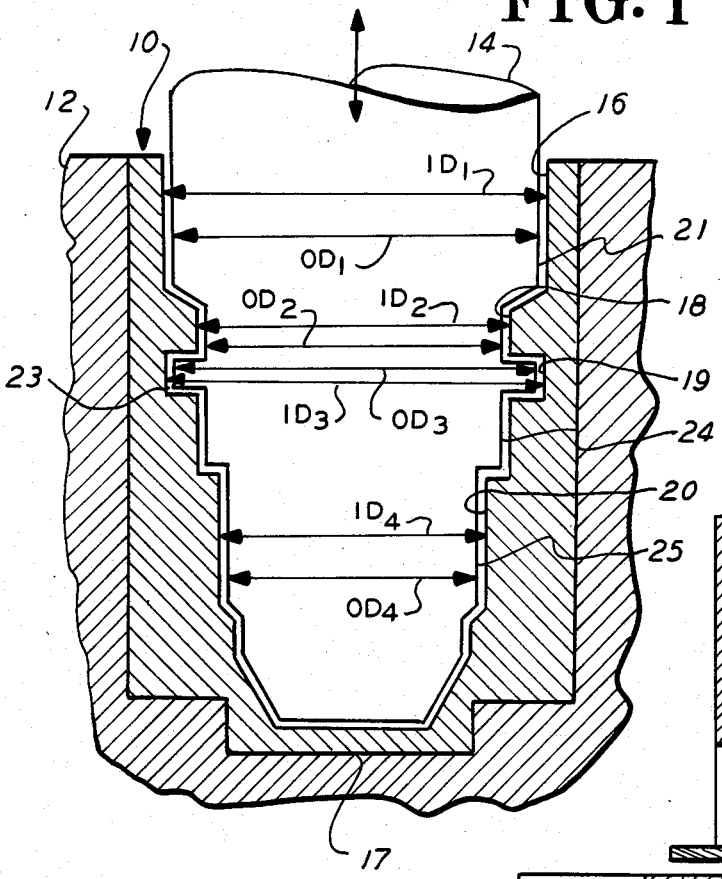
FIGS. 1 and 2 are cross-sectional elevational views of closed shells which may be formed advantageously by the apparatus and process of the present invention.

Referring now to FIGS. 3–7, there is shown apparatus embodying the present invention, and for practicing the process of manufacture of the present invention, indicated by general numerical designation 40. Generally, such apparatus 40 is for forming a shell of the type illustrated in FIGS. 1 and 2, from a shell blank cut or sheared from blank material strip stock 42. Apparatus 40 may include a draw punch or mandrel 44 including an expandable and contractable intermediate portion 43, a blanking punch or ram 46, blanking die and cover plate 48, iris die indicated by general numerical designation 50 including a plurality of edge punches or iris forming members **51*a* and 51*d* (better seen in FIG. 8 as edge punches or iris forming members 51*a*–51*f*), forming die 52, shoulder punch or ram 54, and back-up die ram and knock-out punch 56; it will be noted that the iris die 50 is mounted circumferentially around the top of the forming die 52, note FIG. 8**.

It will be understood by those skilled in the art, and referring to FIGS. 3–7, that the draw punch or mandrel 44, blanking punch or ram 46, edge punches or iris forming members 51, shoulder punch or ram 54 and back-up die ram and knock-out punch 56 are mounted reciprocably and as double acting pistons as shown; the draw punch or mandrel 44 and blanking punch or ram 46 are mounted concentrically and telescopically as shown and the forming die 52, shoulder punch or ram 54 and back-up die ram and knock-out punch 56 are mounted concentrically and telescopically as shown. It will be further understood that the associated entrance and exit pressurized fluid ports are not shown for clarity of presentation.

It will still be further understood by those skilled in the art that the pressurized fluid or hydraulic control circuitry for operating the structural elements of apparatus 40, although not shown, may be any one of several suitable pressurized fluid or hydraulic circuitry systems known to the art which, as will be further understood by those skilled in the art, may be operated in the manner known to the art for controlling the operation and sequence of operation of such structural elements as described below.

Referring now generally to the operation of apparatus 40 embodying the present invention, and for practicing the process of manufacture of the present invention, as noted above, such is for forming a closed shell 60 (FIGS. 6 and 7) of the type described above and illustrated in FIGS. 1 and 2, from a shell blank cut or sheared from shell material strip stock 42, FIG. 3. Referring now to FIG. 3, it will be understood that the above-described structural elements comprising the apparatus 40 will initially occupy the positions shown with the shell material strip stock 42 having been advanced, by suitable means not shown but known to those skilled in the art, into the position shown in FIG.

3. As illustrated in FIG. 4, the blanking punch or ram 46 is advanced downwardly to shear or cut a shell blank 62 from the strip 42; as shown in FIG. 8 the shell blank 62 may be suitably shaped for having its circumferential edges engaged complementarily by the forming edges 53*a*–53*f* of the edge punches or iris forming members 51*a*–51*f*, for example, the shell blank 62 may be cut or sheared into a hexagonal shape as shown in FIG. 8, and it will be understood that for such hexagonal shaping the blanking punch or ram 46 and blanking die and cover plate 48 would be of complementary shape or cross-sectional configuration. The draw punch or mandrel 44 is then advanced downwardly at a constant rate and the edge punches or iris forming members 51*a*–51*f* are advanced radially inwardly in the directions of the arrows 71–76 in FIG. 8 to apply radially inward force to the circumferential edge of the blank 62 to force or extrude the shell blank 52 towards the downwardly moving draw punch or mandrel 44 to form the shell 60 between the lower portion of the mandrel 44 and the forming die 52 with the exterior surface of the mandrel defining or forming the interior surface of the shell 60 and with the interior surface of the forming die 52 defining or forming the exterior surface of the shell 60. It will be understood that at each increment of downward movement of the draw punch or mandrel 44, the radially inwardly advancing or moving edge punches or iris forming members 51*a*–51*f* supply the proper volume of blank material to provide the proper wall thickness of the formed shell 60.

The operation of the iris die 50 as described above may be better understood by reference to FIGS. 8–10 wherein, it will be noted, as stated above, the edge punches or iris forming members 51*a*–51*f*, are mounted reciprocably as double-acting pistons and in forming the shell 60, particularly as illustrated in FIG. 5, the iris forming members 51*a*–51*f* are advanced inwardly in the directions of the arrows 71–76 to cause the forming edges 53*a*–53*f* of the iris forming members 51*a*–51*f* to apply radially inwardly acting force to the circumferential edge, or edges, of the blank 62 as indicated in FIG. 8 by the arrows 81–86. A better understanding of the individual structure or shape of each iris forming member 51 may be better understood by reference to FIG. 9 where there is illustrated individually edge punch or iris forming member 51*a*.

In accordance with the further teachings of the present invention, particularly with regard to the iris die 50 and as may be best seen in FIGS. 8 and 9, a hydrostatic bearing may be provided for each iris forming member (the hydrostatic bearings being indicated by numerical designations 81–86 with one associated with each iris forming member as shown) for applying inwardly acting hydrostatic force, as indicated by arrows 88 and 89, the iris forming members 51*a*–51*f* as shown in FIG. 8, to compensate for the edge punch or iris forming member load, or reaction force, produced in opposition to the radially inwardly acting forces indicated by arrows 81–86. Thus, it will be understood that the hydrostatic bearings 81–86 assist in facilitating the edge punches or iris forming members 51*a*–51*f* in applying the radially inward force indicated by arrows 81–85 to the circumferential edge or edges of the blank 62 in extruding the blank radially inwardly as described above to form the shell 60. The hydrostatic bearings 81–86 may be provided with suitable seals as shown in FIG. 8 and may be supplied with suitable pressurized fluid or hydraulic pressure through suitable inlet ports as indicated in dashed outline in FIG. 8.

Referring again to FIGS. 4 and 5, it will be further understood and in accordance with the further teachings of the present invention that at each increment of draw punch or mandrel 44 downward movement, and upon each increment of radially inward movement of the edge punches or iris forming members 51*a*–51*f*, the back-up die ram and knock-out punch 56 is moved downwardly to provide back-up force or pressure to the blank 62 during forming of the shell 60. Upon the blank 60 being formed into the shell configuration shown in FIG. 5, the shoulder punch or ram 54 is advanced upwardly as shown in FIG. 6 to form a shoulder on the bottom of the shell 60 such as the shoulder 39 of shell 30 of FIG. 2.

Figure 2:
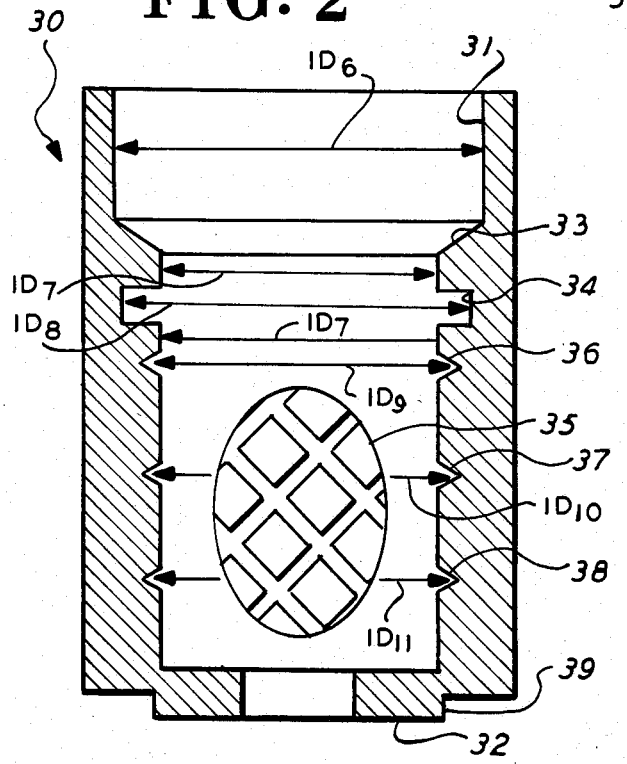

It will be generally understood, in accordance with the teachings of the present invention, that during the forming of the shell blank 62 into the shell 60, particularly as illustrated in FIG. 5, the expandable and contractable intermediate portion 43 of the draw punch or mandrel 44 is expanded radially outwardly to provide the shell 60 with an internal portion such as internal portion 19 of FIG. 1 or 34 of FIG. 2 having an internal diameter such as internal diameter $ID_3$ of FIG. 1 or $ID_8$–$ID_{11}$ of FIG. 2, larger than the internal diameter $ID_2$ of internal portion 18 of FIG. 1 or $ID_7$ of internal portion 33 of FIG. 2; the specific structure and function of the mandrel expandable and contractable intermediate portion 43 embodying the present invention is described in detail below and illustrated in alternative embodiments in FIGS. 11–16 and FIGS. 17–19. At this time, as illustrated in FIG. 6, the shell 60 is fully formed.

Figure 7:
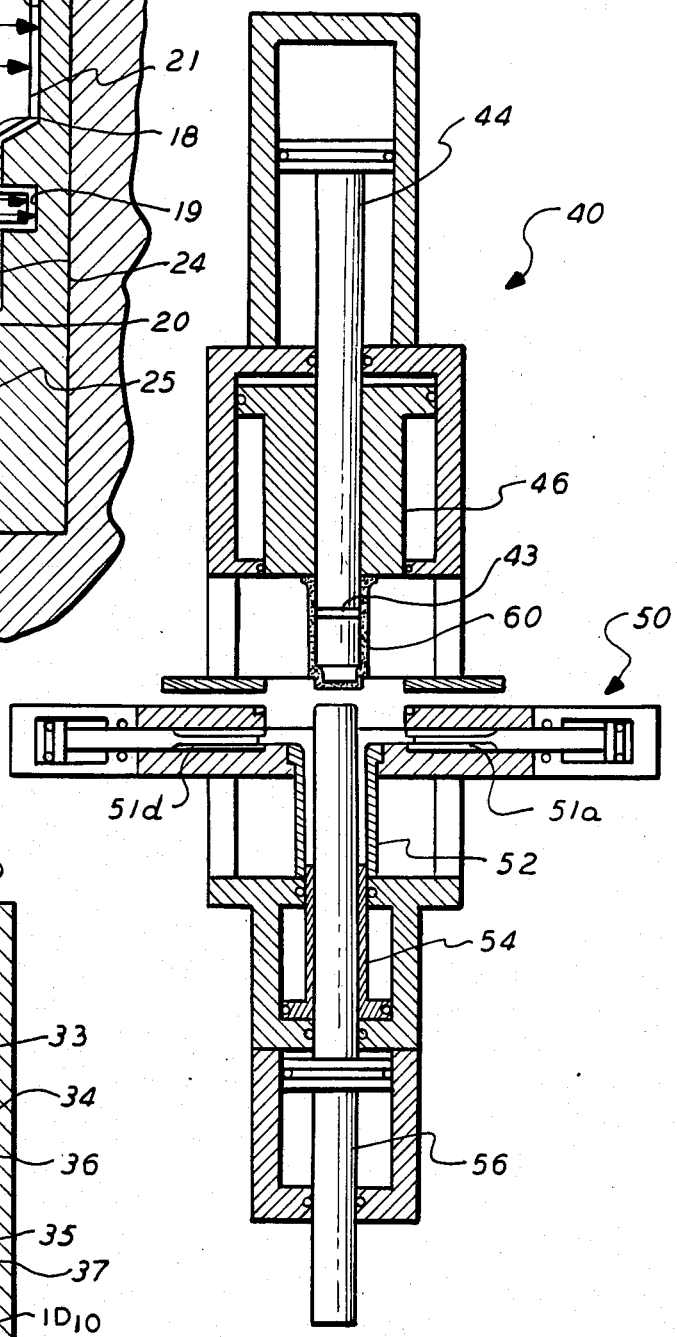

Thereafter, blanking punch or ram 46, shoulder punch or ram 54, and edge punches or iris forming members 51*a*–51*f* are retracted to the positions shown in FIG. 7. Then, the draw punch or mandrel 44 is retracted upwardly and the back-up die ram and knock-out punch 56 is advanced upwardly following the mandrel 44 to remove or extract the formed shell 60 from the forming die 52 with the formed shell 60 remaining attached to the lower end of the mandrel 44, this continues until the back-up die ram and knock-out punch 56 has reached its position shown in FIG. 7. Thereafter, the draw punch or mandrel 44 continues to be retracted upwardly with the formed shell 60 attached to its lower end as shown in FIG. 7 until the upper end of the formed shell 60 strikes the blanking punch or ram 46 which causes, as will be described in detail below and as shown in the alternate embodiments of FIGS. 11–16 and 17–19, the expandable and contractable intermediate portion 43 of the mandrel 44 to contract inwardly to permit the portions of the mandrel forming the internal portions, such as internal portions 19 of FIG. 1 and 34 of FIG. 2 having respectively internal diameters $ID_3$ and $ID_8$–$ID_{11}$ larger than internal diameter of internal portions 18 of FIG. 1 and 33 of FIG. 2, to contract and permit the mandrel to be moved or retracted past the internal portions, such as internal portion 18 of FIG. 1 and internal portion 33 of FIG. 2, and permit the mandrel to be pulled out or separated from the formed shell passing through the open end of the formed shell thereby permitting the mandrel and formed shell to be separated.

Subsequently, the formed shell 60 may be transferred by suitable means known to the art from the apparatus 40 for a possible trimming operation to provide the formed shell with a further or better defined upper end as shown with regard to the shells 10 and 30 illustrated in FIGS. 1 and 2.

Figure 11:
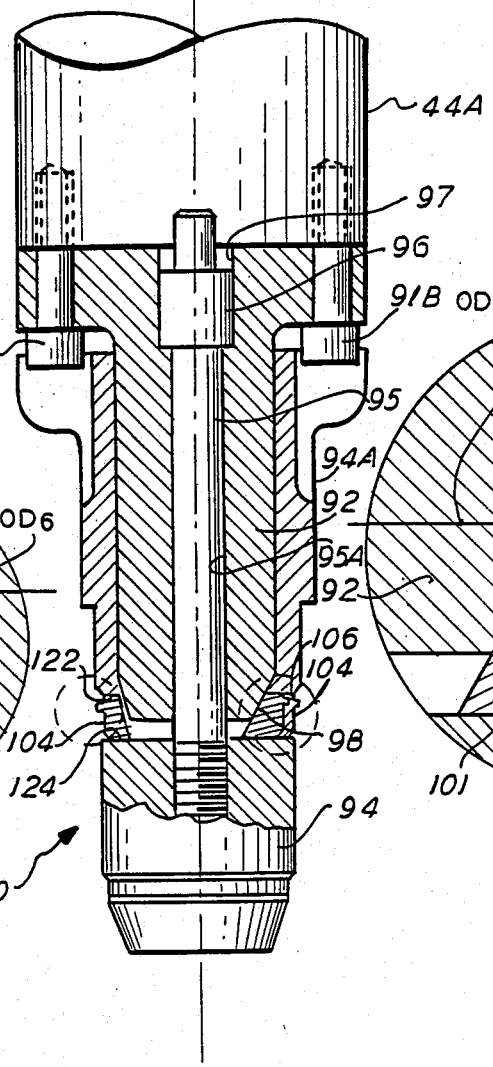
FIG. 11 is an elevational cross-sectional view of a mandrel embodying the present invention and including an intermediate portion expandable outwardly to form an internal portion of a closed shell and contractable inwardly to permit the formed shell and mandrel to be separated.
Figure 11B:
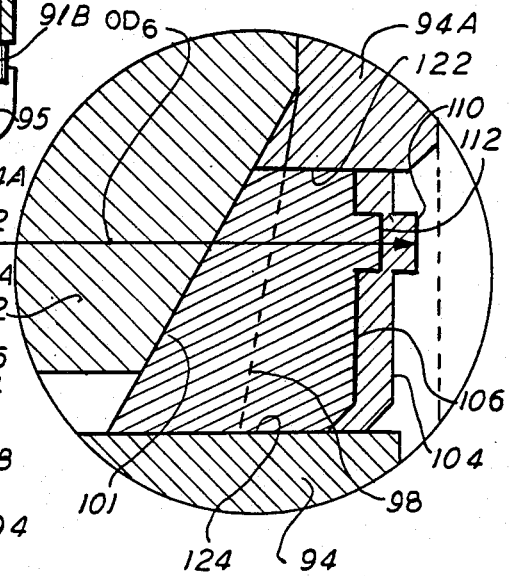
Figure 13A:
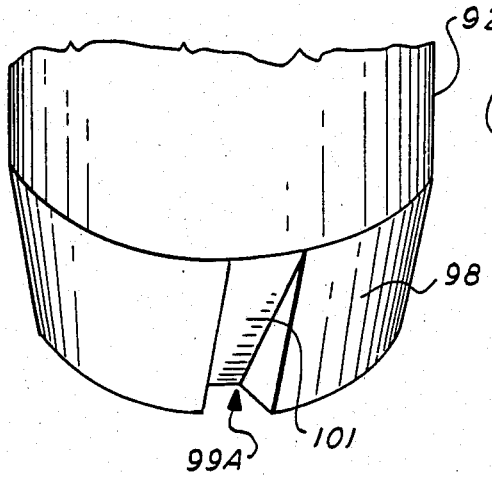
FIGS. 13A and 13B are diagrammatical illustrations of the lower end of an internal portion of the mandrel embodying the present invention and illustrating differential angles of respective camming surfaces with respect to the axis of the mandrel.
Figure 13B:
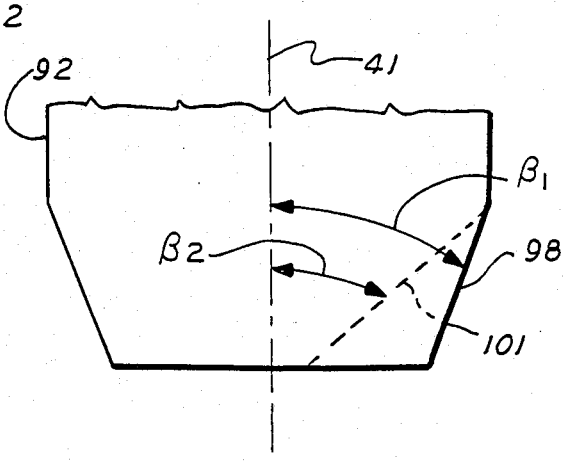
Figure 12:
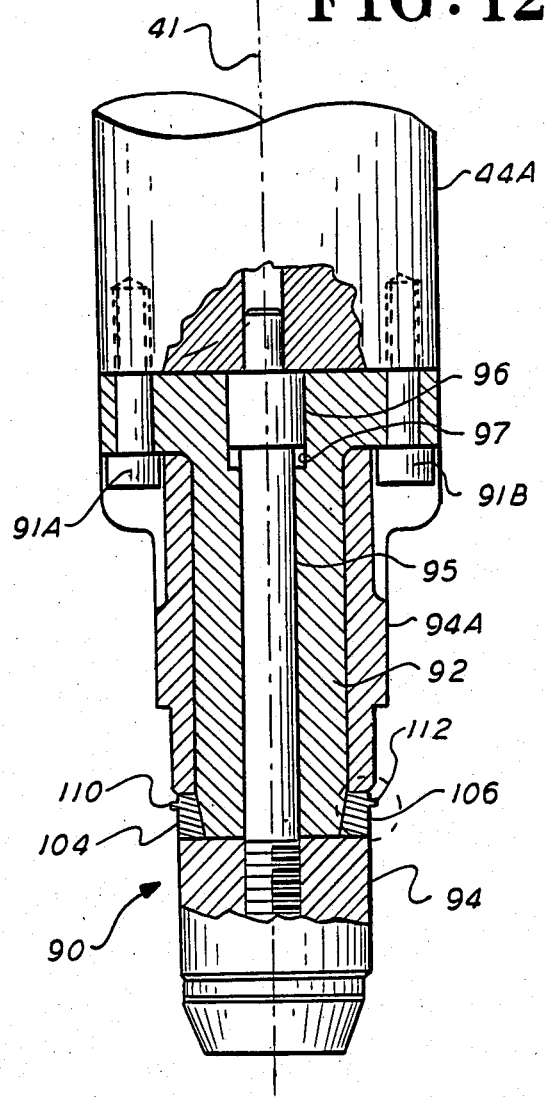
FIG. 12 is a view similar to FIG. 11 but with the intermediate portion of the mandrel expanded radially outwardly.

Detailed structure of a preferred embodiment of a draw punch or mandrel 44A in accordance with the teachings of the present invention is illustrated in FIGS. 11–16 and which is particularly useful for forming shell 10 of FIG. 1. The mandrel 44A of FIGS. 11–16 has an axis 41 and, as described above, is provided with an outer surface indicated by general numerical designation 90 for defining or forming the interior surface of a shell, such as shell 10 of FIG. 1. The lower end of the draw punch or mandrel 44A, as shown in FIGS. 11, 12 and 16, may include an upper portion 92 secured to the mandrel 44A by suitable threaded members 91A and 91B as shown and may include a lower portion 94 connected (FIG. 16) to a cylindrical portion 94A, surrounding upper portion 92, by a rod 95 extending through a passageway 95A formed centrally of the mandrel upper portion 92 and a cross member 96; threaded members 97A and 97B interconnect the cross member 96 and portions 94A as may be best seen in FIG. 16. Lower portion 94 hangs or depends below upper portion 92 being supported by the rod 95 and the cross member 96 residing in an axially (vis-a-vis mandrel axis 41) oversized slot 97 formed at the top of upper portion 92. It will be understood that the upper portion 92 and lower portion 94 are movable relatively towards and away from each other, with the upper portion 92 sliding within portion 94A, upon the mandrel 44A being advanced downwardly and retracted upwardly as described above with regard to mandrel 44; as shown in FIG. 11, the upper portion 92 is moved upwardly or away from the lower portion 94 and in FIGS. 12 and 16 the upper portion 92 is shown moved downwardly towards lower portion 94. As may be best understood by reference to FIGS. 11B, 13A and 13B, the upper portion 92 of mandrel 44A is provided at its lower end with a conical portion 98 tapering toward the lower portion 94 and radially inwardly at a first angle $\beta_1$ with respect to the mandrel axis 41 (note particularly FIG. 13B). The conical portion 98, as may be best seen in FIG. 13A, is provided with a radial slot 99 partially defined by a surface 101 inclined inwards toward the lower mandrel portion 94 and radially inwardly at a second angle $\beta_2$ with respect to the mandrel axis 41 (best seen in FIG. 13B), with it being understood that angle $\beta_1$ is less than angle $\alpha_2$ and vice versa.

Figure 14:
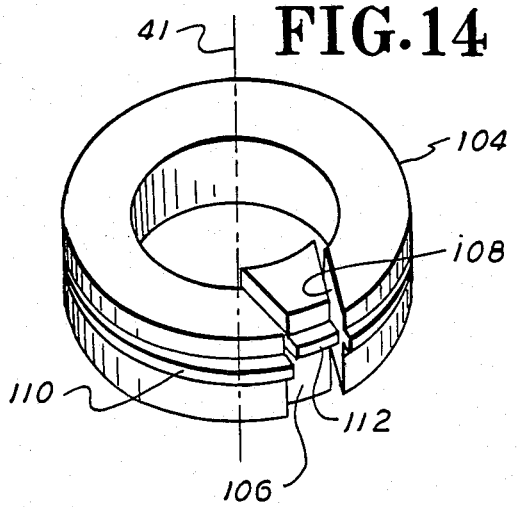
FIG. 14 is a perspective illustration of an interrupted annular member and wedge member comprising an embodiment of the intermediate portion of the mandrel of the present invention which intermediate portion may be expanded radially outwardly and contracted radially inwardly.
Figure 15A:
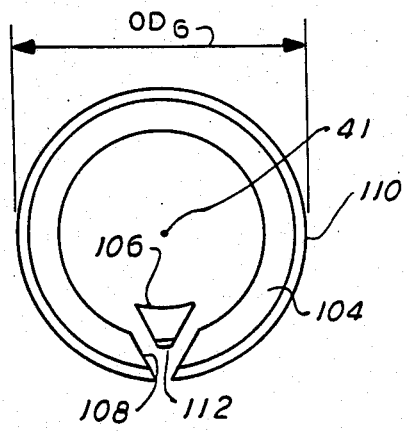
FIGS. 15A and 15B are diagrammatical illustrations of top views of the annular member and wedge member of FIG. 14.
Figure 15B:
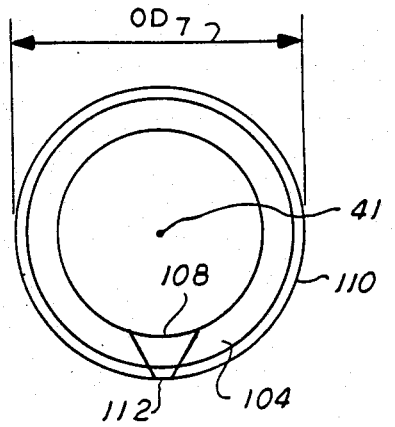

The above-described expandable and contractable intermediate portion 43 of draw punch or mandrel 44 may be embodied as the annular member 104 and wedge member 106, best seen in FIGS. 14 and 15. The annular member 104 is provided with a peripheral or radial interruption 108 in which is mounted the wedge member 106 and it will be noted, also best seen in FIGS. 14 and 15, that the wedge member 106 tapers radially outwardly with respect to the mandrel axis 41. As may be best understood from FIGS. 11, 12 and 16, the interrupted annular member 104 surrounds the conical portion 98 of upper mandrel portion 92 with its inner surface residing slidably against the conical portion 98 and the inner surface of wedge member 106 resides slidably against the inclined surface 101. The annular member 104 (FIGS. 14 and 15) is provided with a radially or peripherally interrupted, radially outwardly extending (with respect to mandrel axis 41) ridge 110 and the wedge member 106 is provided with a radially outwardly extending ridge 112; as will be explained in detail below, the ridges 110 and 112 are for forming the internal portion 19 of shell 10 of FIG. 1 having internal diameter $ID_3$.

It will now be assumed that mandrel 44A of FIGS. 11–16 is substituted for mandrel 44 of FIGS. 3–7, that mandrel 44A is occupying the position shown for mandrel 44 in FIG. 3, i.e. mandrel 44A is in its initial position, and that mandrel 44A and the forming die 52 (FIGS. 3–7) are for forming the shell 10 of FIG. 1 from shell blank 62 (FIG. 4). In this initial position, the upper portion 92 of mandrel 44A will be retracted and moved upwardly away from the lower mandrel portion 94 and the annular member 104 and wedge member 106 will occupy the contracted or radially inward positions shown in FIGS. 11, 11B, 14 and 15A with the wedge member 106 residing radially inwardly of the annular member 104 and with the interrupted ridge 110 of annular member 104 having an outer diameter $OD_6$ (also note FIGS. 11A and 11B) slightly less than, by a predetermined amount as understood by those skilled in the art, the internal diameter $ID_2$ (FIG. 1) of internal portion 18 of shell 10. Upon downward movement of the mandrel 43A, the lower portion 94 of the mandrel 44A will first engage and temporarily come to a stop against the shell blank 62 and upon continued downward movement of the mandrel 44A, the upper portion of the mandrel 92 will move downwardly until it engages the mandrel lower portion 94. As the upper mandrel portion 92 moves into engagement with the lower mandrel portion 94, and since angle $\beta_1$ (FIG. 13B) of the conical surface 98 is less than angle $\beta_2$ of the surface 101 against which the wedge member 106 resides, the conical surface 98 of upper mandrel portion 92 will first cam and expand annular member 104 radially outwardly and thereafter, since angle $\beta_2$ is larger than angle $\beta_1$, the inclined surface 101 will cam wedge member 106 radially outwardly to fill the radial interruption 108 (FIG. 14) of the annular member 104 with the wedge member 106 and the expanded annular member 104 forming a complete annulus as shown in FIGS. 12 and 15B and with the interrupted annular ridge 110 of the annular member 104 and the ridge 112 of the wedge member 108 forming a complete annular ridge having an outer diameter $OD_7$ (also note FIG. 12A), substantially equal to, or slightly less than by a predetermined amount as understood by those skilled in the art, the inner diameter $ID_3$ of internal portion 19 of the shell 10 of FIG. 1. Thereafter, as described above with regard to the forming of shell 60 and as illustrated in FIGS. 4 and 5, the shell 60 is formed between the outer surface 90 of the mandrel 44A and the inner surface of the forming die 52 of FIGS. 4 and 5 and with the completed annular ridge comprised of interrupted ridge 110 of the annular member 104 and the ridge 112 of the wedge member 106 forming the internal portion 19 of shell 10 (FIG. 1) having internal diameter $ID_3$. Upon the shell 10 being formed as illustrated in FIG. 6 with regard to shell 60, the mandrel 44A is retracted upwardly with the formed shell 10 residing on the lower portion thereof as shown in FIG. 7 with regard to mandrel 44, and upon the shell 10 engaging the blanking punch or ram 46 as shown in FIG. 7 and described above, the upward movement of the lower portion 94 of the mandrel 44A will stop its upward movement, but the upper portion 92 of the mandrel 44A will continue to move or be retracted upwardly away from the lower portion 94 until the mandrel upper portion 92 occupies the position shown in FIG. 11; as the upper mandrel portion 92 is retracted upwardly away from the lower mandrel portion 94, since angle $\beta_2$ is larger than angle $\beta_1$ (FIG. 13B), the wedge member 106 first moves radially inwardly of the annular member 104 sliding against inclined surface 101 whereafter, since angle $\beta_1$ is less than angle $\beta_2$, the annular member 106 contracts radially inwardly sliding against the conical surface 98 (FIGS. 13A and 13B) and occupying the position shown in FIGS. 11, 11B, 14 and 15 with the ridges 110 and 112 of the annular member and wedge member being contracted radially inwardly such that the interrupted annular ridge 110 now has outer diameter $OD_6$ of FIG. 15A substantially equal to or slightly less than the internal diameter $ID_2$ of internal portion 18 of shell 10 (FIG. 1) thereby permitting the mandrel 44A to continue to be moved or retracted upwardly, with the contracted annular member 104 and the lower portion of the mandrel 44A sliding past internal portion 18 of the formed shell having $ID_2$ without damage to the formed shell and thereby permitting the formed shell 10 and mandrel 44A to be separated.

Referring again to FIGS. 11, 11A, 11B and 12, and the positions occupied by the annular member 104, wedge member 106, and upper and lower mandrel portions 92 and 94 during shell forming, it will be noted that the annular member 104, wedge member 106, and upper and lower mandrel portions 92 and 94 are provided with a plurality of contiguous, internal surfaces (not individually numbered to reduce the amount of numerals used for the sake of clarity) of complementary shape, which internal surfaces during shell forming are engageable to form the mandrel 44A into a solid, or substantially solid, mandrel to enhance forming of the shell.

Figure 11A:
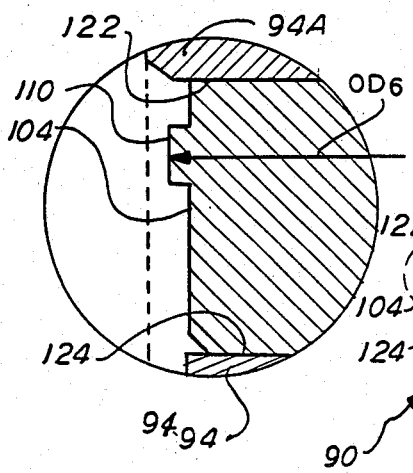
FIGS. 11A and 11B are enlarged views of portions of FIG. 11 as indicated in the drawings.
Figure 12A:
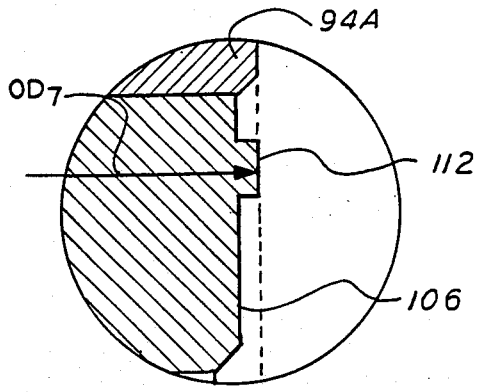
FIG. 12A is an enlarged view of a portion of FIG. 12 as indicated in the drawings.

As may be best understood from FIGS. 11A and 11B, mandrel portions 94A and 94 are provided with opposed surfaces 122 and 124, respectively, spaced apart a distance substantially equal to the axial length, or height, of the annular member 104 and wedge member 106 with such members slidable thereagainst. The opposed surfaces 122 and 124 are for preventing relative axial movement (vis-a-vis mandrel axis 41) between the annular member 104 and wedge member 106 thereby restricting their movements during radial expansion and contraction to radial movement.

Figure 18:
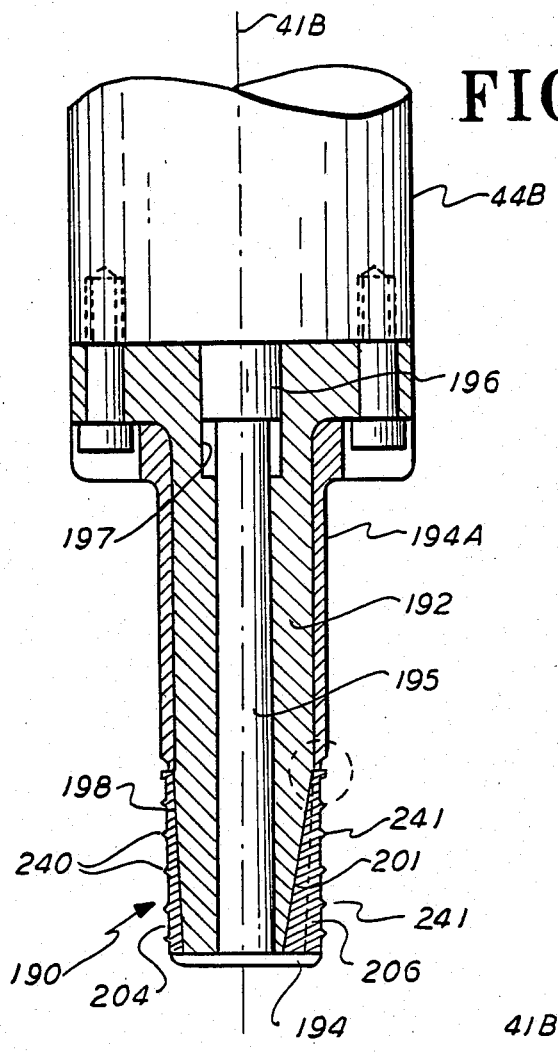
FIG. 18 is a view similar to FIG. 12 but of the alternate embodiment of FIG. 17.
Figure 18A:
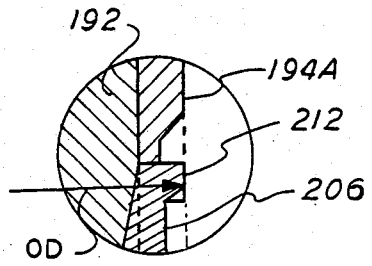
FIG. 18A is an enlarged view of FIG. 18 as indicated in the drawing.
Figure 19:
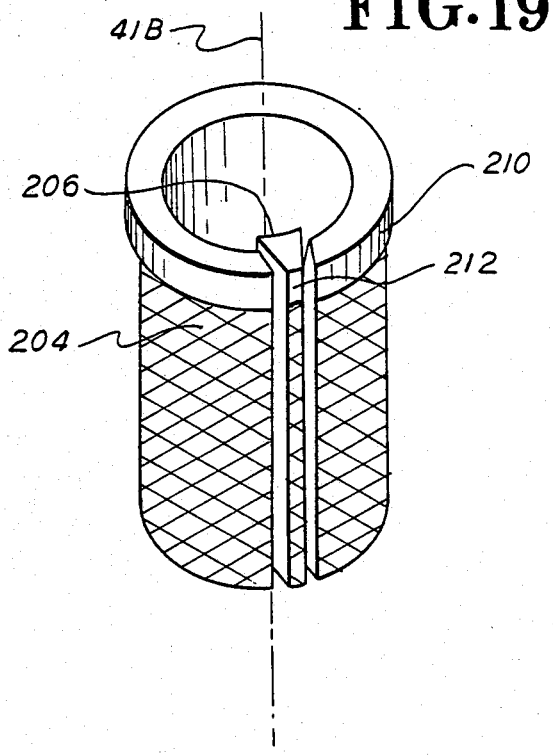
FIG. 19 is a view similar to FIG. 14 but of the interrupted annular member and wedge member of the alternate embodiment of the mandrel of the present invention.

Detailed structure of an alternate preferred embodiment of a draw punch or mandrel 44B in accordance with the teachings of the present invention is illustrated in FIGS. 17–19 and which is particularly useful for forming shell 30 of FIG. 2. The mandrel 44B has an axis 41B and is provided with an outer surface indicated by general numerical designation 190 for defining or forming the interior surface of a shell, such as shell 30 of FIG. 2. The lower end of draw punch or mandrel 44B, as shown in FIGS. 17 and 18 may include an upper portion 192 secured to the mandrel 44B by suitable threaded members as shown and may include a lower portion 194 connected to a cylindrical portion 194A, surrounding upper portion 192, by a rod 195 formed integrally with lower portion 194 and which rod extends through a passageway 195 formed centrally of the mandrel upper portion 192 and a cross member 196 residing in an axially oversized slot 197 formed at the top of upper portion 192. Lower mandrel portion 194 hangs or depends below the upper mandrel portion 192 being supported by the rod 195 and cross member 196. It will be understood that the upper portion 192 and lower portion 194 are movable relatively towards and away from each other with the upper mandrel portion 192 sliding within the lower portion 194 upon the mandrel 44B being advanced downwardly and retracted upwardly as described above with regard to mandrel 44A; in FIG. 17, the upper mandrel portion 192 is shown moved upwardly or away from the lower mandrel portion 194 and in FIG. 18 the upper mandrel portion 192 is shown moved downwardly towards lower mandrel portion 194. As may be understood by reference to FIG. 17, the upper mandrel portion 192 is provided at its lower end with a conical portion 198 tapering toward the lower portion 194 and radially inward at a first angle $\beta_3$ with respect to the mandrel axis 41B. The conical portion 198, it will be understood, is provided with a radial slot (analogous to radial slot 99 of FIG. 13A) partially defined by a surface 201 inclined inwardly towards the lower mandrel portion 194 and radially inwardly at a second angle $\beta_4$ with respect to the mandrel axis 41B with it being understood that angle $\beta_3$ is less than angle $\beta_4$ and vice versa.

In mandrel embodiment 44B, the annular member 104 and wedge member 106 of mandrel embodiment 44A are replaced, respectively, by annular or cylindrical member 204 and wedge member 206 as may be best seen in FIG. 19; annular member 204 resides slidably against conical surface 198 of upper mandrel portion 192 and wedge member 206 resides slidably against inclined surface 201 partially defining the radial slot formed in the upper mandrel portion 192. As also may be best seen in FIG. 19, annular member 204 is provided with a radially outwardly extending ridge 210 and wedge member 206 is provided with a radially outwardly extending ridge 212; the ridges 210 and 212 are for forming the internal portion 34 of shell 30 (FIG. 2) having internal diameter $ID_8$.

It will be further understood that the outer surface of annular member 204 and wedge member 106 in addition to the ridges 210 and 212 are also provided, respectively, with radially outwardly extending ridges indicated diagrammatically in FIG. 19 by the crisscross lines and by the respective ridges shown in FIGS. 17 and 18 identified by numerical designations 240 and 241 for engaging and embossing (i.e. by providing ridges 36, 37 and 38 of FIG. 2) the lower interior portion of the shell 30 (FIG. 2) with a predetermined pattern (e.g. area 35 of FIG. 2) to enhance fragmentation of the grenade body 30. It will be understood that upon the annular member 204 and wedge member 206 being contracted radially inwardly the ridges 210 of annular member 204 will have an outer diameter $OD_7$ slightly less than internal diameter $ID_7$ of internal portion 33 of shell 30 of FIG. 2, and upon the annular member 204 and wedge member 206 being expanded radially outwardly the ridges 210 and 212, and ridges 240 (formed on annular member 204) and 241 (formed on wedge member 206) providing the abovenoted embossing, will have an outer diameter $OD_8$ slightly less than, by a predetermined amount, the internal diameters $ID_8$–$ID_{11}$ of FIG. 2. It will now be understood that upon the mandrel 44B being substituted for mandrel 44A, mandrel 44B will perform substantially the same function as mandrel 44A with the annular member 204 and wedge member 206 being expanded and contracted thereby performing substantially the same functions as annular member 104 and wedge member 106 of mandrel 44A.

It will be understood by those skilled in the art that the above-described operation and mounting of the structural elements of apparatus embodying the present invention are merely illustrative of the present invention and that other structure, structural mountings and relative movements are possible within the scope of the present invention, for example instead of mounting the forming die stationarily and the mandrel reciprocably for movement toward and away from the forming die, the mandrel may be mounted stationarily and the forming die may be mounted reciprocably for movement toward and away from the mandrel, or both may be mounted reciprocably for movement toward and away from each other; the significant movement being relative movement toward and away from each other. Further, it will be understood that while the apparatus embodying the present invention illustrated in the figures is oriented vertically, the present apparatus is not so limited and apparatus embodying the present invention may be oriented differently, such as for example may be oriented horizontally.

Further, it will be understood by those skilled in the art that many modifications and variations may be made in the present invention without departing from the spirit and the scope thereof.

What is claimed is:

1. Apparatus for forming from a generally cylindrical flat blank having a circumferential edge a generally cylindrical shell having interior and exterior surfaces, an open end with a first internal diameter, a generally closed opposite end, a first internal portion intermediate said ends with a second internal diameter smaller than said first internal diameter, and a second internal portion intermediate said first internal portion and said closed opposite end with a third internal diameter larger than said second internal diameter, comprising:

a forming die provided with an inner surface for forming the exterior surface of said shell;

a mandrel having an axis and provided with an outer surface for forming the interior surface of said shell, said mandrel and said forming die mounted for relative movement towards each other to form said shell, said forming die having a top into which said mandrel enters;

said mandrel comprised of a plurality of distinct members mounted for relative movement with respect to each other, predetermined ones of said members expandable radially outwardly with respect to said mandrel axis to form said second internal portion and upon said shell being formed, said predetermined ones of said members contractable radially inwardly sufficiently to permit said mandrel to be moved relatively away from said formed shell through said open end to permit said formed shell and said mandrel to be separated; and an iris die mounted circumferentially around the top of said forming die, said iris die comprising a plurality of reciprocally mounted iris forming members for applying radially inward force to said blank circumferential edge upon said relative movement of said forming die and mandrel towards each other to facilitate forcing of said blank into said forming die and between said mandrel and said forming die to form said shell.

2. Apparatus for forming from a generally cylindrical flat blank having a circumferential edge a generally cylindrical shell having an open end having a first internal diameter, a generally closed end, a first internal portion intermediate said ends and having a second internal diameter smaller than said first internal diameter, and a second internal portion intermediate said first internal portion and said closed end and having a third internal diameter larger than said second internal diameter, comprising:

a forming die provided with an inner surface for forming the exterior surface of said shell;

a mandrel having an axis and provided with an outer surface for forming the interior surface of said shell, said mandrel and said forming die mounted for relative movement towards each other to form said shell therebetween, said forming die having a top into which said mandrel enters;

said mandrel comprised of a plurality of distinct members mounted for relative movement with respect to each other, in response to first predetermined relative movement between first predetermined ones of said distinct members, second predetermined ones of said distinct members expandable radially outwardly with respect to said mandrel axis to form said shell second internal portion, and in response to the second predetermined relative movement between said first predetermined ones of said distinct members, said second predetermined ones of said distinct members contractable radially inwardly sufficiently to permit said mandrel to be moved relatively away from said formed shell through said shell open end to permit said formed shell and said mandrel to be separated; and an iris die mounted circumferentially around the top of said forming die, said iris die comprising a plurality of reciprocally mounted iris forming members for applying radially inward force to said blank circumferential edge upon said relative movement of said forming die and mandrel towards each other to facilitate forcing of said blank into said forming die and between said mandrel and said forming die to form said shell.

3. Apparatus according to claim 2 wherein said plurality of distinct mandrel members are provided with a plurality of contiguous, internal surfaces of complementary shape, prior to said shell being formed said members engageable to form said mandrel members into a substantially solid mandrel to enhance forming of said shell.

4. Apparatus according to claim 2 or 3 wherein third predetermined ones of said plurality of distinct members are provided at their outer surfaces with crisscross ridges formed in a predetermined pattern for engaging and embossing predetermined portions of the interior of said shell to enhance the fragmentation of said shell.

5. Apparatus for forming a generally cylindrical shell having an open end having a first internal diameter, a generally closed opposite end, a first internal portion intermediate said ends having a second internal diameter smaller than said first internal diameter, and at least one additional internal portion intermediate said first internal portion and said closed end having a third internal diameter larger than said second internal diameter, comprising:

a forming die provided with an inner surface for forming the exterior surface of said shell;

a mandrel having an axis and provided with an outer surface for forming the interior surface of said shell;

said mandrel including a first portion and a second portion mounted for relative movement toward and away from each other, said mandrel first portion provided with a conical portion tapering toward said second portion and radially inwardly at a first angle with respect to said axis and said conical portion provided with a radial slot partially defined by an inclined surface inclined towards said second mandrel portion and radially inwardly at a second angle with respect to said axis, said first angle less than said second angle, said mandrel including an annular member surrounding and residing slidably against said conical portion, said annular member provided with a radial interruption tapering radially outwardly with respect to said axis and said annular member provided with a radially interrupted, radially outwardly extending first ridge, and said mandrel further including a wedge member mounted in said radial interruption and tapering radially outwardly with respect to said axis, said wedge member residing slidably against said inclined surface and said wedge member provided with a radially outwardly extending second ridge, prior to forming said shell said mandrel first portion disposed away from said mandrel second portion with said annular member contracted radially inwardly and with said wedge member residing radially inwardly of said contracted annular member, said first ridge of said contracted annular member having an outer diameter less than said shell second internal diameter, upon forming the interior surface of said shell said mandrel first portion moving relatively toward said mandrel second portion to cause said conical portion due to said first angle being less than said second angle to first cam and expand said annular member radially outwardly and thereafter due to said second angle being greater than said first angle to cause said inclined surface to cam said wedge member radially outwardly to fill said radial interruption with said first and second ridges of said expanded annular member and said wedge forming a complete annular ridge having an outer diameter substantially equally to said shell third internal diameter whereupon said shell at least one additional internal portion is formed around said complete annular ridge, upon said shell being formed said mandrel first portion moving relatively away from said mandrel second portion whereupon said wedge member due to said second angle being greater than said first angle moves radially inwardly of said annular member in said radial interruption and whereafter due to said second angle being greater than said first angle said annular member contracts radially inwardly with said first ridge having said outer diameter less than said shell second internal diameter thereby permitting said mandrel to be moved relatively away from said formed shell without damage thereto and through said open end to permit said formed shell and said mandrel to be separated.

6. Apparatus according to claim 5 wherein said mandrel first and second portions, said annular member and said wedge member are provided with a plurality of contiguous, internal surfaces of complementary shape, upon said mandrel first portion moving relatively toward said mandrel second portion, said internal surfaces engageable to form said mandrel first and second portions, said annular member and said wedge member into a substantially solid mandrel to enhance forming of said shell.

7. Apparatus according to claims 5 and 6 wherein said shell is a grenade body and wherein the outer surface of said mandrel second portion is provided with radially outwardly extending crisscross ridges formed in a predetermined pattern for engaging and embossing the lower interior portion of said shell with said predetermined pattern to enhance fragmentation of said grenade body.

8. Apparatus according to claim 5 wherein said shell is formed from a generally cylindrical, flat blank having a circumferential edge, and wherein said apparatus further comprises an iris die mounted circumferentially around the top of said forming die, said iris die comprising a plurality of reciprocally mounted iris forming members for applying radially inward force to said blank circumferential edge upon said relative movement of said forming die and mandrel towards each other to facilitate forcing of said blank into said forming die and between said mandrel and said forming die to form said shell.

9. Apparatus according to claim 8 wherein said iris die further comprises a hydrostatic bearing associated with each iris forming member for applying inwardly acting hydrostatic force to each iris forming member to assist and facilitate said iris forming members in applying said radially inward force to said blank circumferential edge.

10. Apparatus according to claim 5 or 6 wherein said mandrel further includes a generally cylindrical member surrounding said mandrel first portion and secured to said mandrel second portion by a rod extending through said mandrel first portion and a crossmember residing in an oversized slot formed in the upper portion of said mandrel first portion, said mandrel upper portion sliding within said generally cylindrical member during said relative movement towards and away from said mandrel second portion, said generally cylindrical member and said mandrel second portion being opposed surfaces for slidably engaging said annular member and said wedge member and for restricting the movements of said annular member and said wedge member during said contraction and expansion to radial movement.

11. Apparatus according to claim 8 wherein said apparatus further includes a reciprocably mounted blanking punch for cutting a shell blank from shell material stock, said blanking punch mounted concentrically with respect to said mandrel and said blanking punch provided with a centrally formed passageway through which the mandrel extends slidably.

12. Apparatus according to claim 11 wherein said shell is provided with an external shoulder surrounding said closed end and wherein said apparatus further includes a shoulder punch for forming said shell shoulder, said shoulder punch mounted reciprocably and concentrically with respect to said forming die and for being advanced into said forming die to form said shell shoulder.

13. Apparatus according to claim 12 wherein said apparatus further includes a back-up die ram and knock-out punch mounted reciprocably and concentrically with respect to said shoulder punch and forming die, upon said relative movement of said mandrel toward said forming die to form said shell, said back-up die ram and knock-out punch for being retracted within said forming die to provide back-up pressure to said shell during said forming, and upon said shell being formed said back-up die ram and knockout punch for being advanced into said forming die to eject said formed shell from said forming die.

14. The process of forming from a shell blank a generally cylindrical shell having interior and exterior surfaces, an open end with a first internal diameter, a generally closed opposite end, a first internal portion intermediate said ends with a second internal diameter smaller than said first internal diameter, and a second internal portion intermediate said first internal portion and said closed opposite end with a third internal diameter larger than said second internal diameter comprising the steps of:

positioning said shell blank between a forming die provided with an inner surface for forming the exterior surface of said shell and a mandrel provided with an outer surface for forming the interior surface of said shell, said mandrel provided with an expandable and contractable intermediate portion;

providing relative movement of said forming die and said mandrel towards each other to force said blank into said forming die between said forming die and said mandrel and expanding said mandrel intermediate portion to form said second internal portion of said shell thereby forming said shell;

retracting said mandrel intermediate portion and providing relative movement between said forming die and said mandrel away from each other to permit said mandrel to be moved relatively away from said formed shell through said open end to permit said formed shell and said mandrel to be separated; and applying radially inward force to a circumferential edge of said blank to assist said forcing of said blank into said forming die between said forming die and said mandrel.

15. Process according to claim 14 wherein said radially inward force applied to the circumferential edge of said blank is applied by a plurality of reciprocably mounted iris forming members of an iris die mounted circumferentially around the top of said forming die, and wherein said process includes the further step of applying inwardly acting hydrostatic force to said iris forming members to assist and facilitate said iris forming members in applying said radially inward force to said blank circumferential edge.

* * * * *